US012420140B2

(12) United States Patent
Schraut et al.

(10) Patent No.: US 12,420,140 B2
(45) Date of Patent: Sep. 23, 2025

(54) EXERCISE APPARATUSES FOR LEG STRENGTHENING

(71) Applicant: Life Fitness, LLC, Rosemont, IL (US)

(72) Inventors: Evan Schraut, Anoka, MN (US); J P Stockton, Red Wing, MN (US); Adam D. Keskey, Buffalo, MN (US)

(73) Assignee: Life Fitness, LLC, Rosemont, IL (US)

( * ) Notice: Subject to any disclaimer, the term of this patent is extended or adjusted under 35 U.S.C. 154(b) by 110 days.

(21) Appl. No.: 18/540,406

(22) Filed: Dec. 14, 2023

(65) Prior Publication Data

US 2025/0195948 A1 Jun. 19, 2025

(51) Int. Cl.

| | |
|---|---|
| ***A63B 23/04*** | (2006.01) |
| ***A63B 21/00*** | (2006.01) |
| ***A63B 21/06*** | (2006.01) |
| ***A63B 21/062*** | (2006.01) |
| ***A63B 23/035*** | (2006.01) |

(52) U.S. Cl.

CPC ..... *A63B 23/0494* (2013.01); *A63B 21/4047* (2015.10); *A63B 2208/0214* (2013.01); *A63B 2225/09* (2013.01)

(58) Field of Classification Search

CPC ..... A63B 23/0494; A63B 21/4047; A63B 2208/0214; A63B 2225/09; A63B 21/15; A63B 23/04; A63B 23/02; A63B 23/035; A61H 1/00; A61H 1/02

See application file for complete search history.

(56) References Cited

U.S. PATENT DOCUMENTS

| | | | |
|---|---|---|---|
| 3,834,694 | A | 9/1974 | Pridgen |
| 4,509,746 | A | 4/1985 | Mask |
| 4,696,469 | A | 9/1987 | Elder |

(Continued)

FOREIGN PATENT DOCUMENTS

| | | |
|---|---|---|
| EP | 3124085 | 5/2018 |
| IE | 20210053 | 9/2022 |

(Continued)

OTHER PUBLICATIONS

The Extended European Search Report for EP Application No. 24216814.4, dated May 8, 2025.

(Continued)

*Primary Examiner* — Bryan Earles

(74) *Attorney, Agent, or Firm* — Andrus Intellectual Property Law, LLP

(57) ABSTRACT

An exercise apparatus for leg strengthening has a frame, a knee support for supporting a knee of a user relative to the frame, a leg brace for bracing a lower leg of the user relative to the frame, and a linkage assembly facilitating performance of a hamstring curl exercise motion wherein a chest of the user is lowered and then raised relative to the frame. The linkage assembly has a driver arm pivotably coupled to the frame and supporting the chest of the user, a loaded arm pivotably coupled to the frame above the driver arm and providing or supporting a load, and a connecting arm pivotably coupling the driver arm to the loaded arm so that lowering of the chest during the hamstring curl exercise motion is resisted by the load and so that raising of the chest during the hamstring curl exercise motion is assisted by the load.

33 Claims, 9 Drawing Sheets

(56) References Cited

U.S. PATENT DOCUMENTS

| | | | | |
|---|---|---|---|---|
| 4,725,056 | A * | 2/1988 | Rehrl | A63B 21/4047 482/901 |
| 5,066,003 | A | 11/1991 | Jones | |
| 5,788,615 | A | 8/1998 | Jones | |
| 6,059,701 | A | 5/2000 | George et al. | |
| 6,394,938 | B1 | 5/2002 | Tornabene | |
| 6,468,188 | B1 | 10/2002 | Koenig | |
| 6,702,724 | B2 | 3/2004 | Taylor et al. | |
| 7,229,394 | B1 | 6/2007 | Tyree | |
| 7,563,209 | B2 | 7/2009 | Webber et al. | |
| 7,935,038 | B2 | 5/2011 | Tyree | |
| 8,007,414 | B2 | 8/2011 | Riney et al. | |
| 9,669,255 | B2 | 6/2017 | Henniger | |
| 10,086,229 | B2 | 10/2018 | Meredith et al. | |
| 10,420,974 | B2 | 9/2019 | Henninger | |
| 10,426,999 | B2 | 10/2019 | Doherty | |
| 10,786,705 | B2 | 9/2020 | Davis et al. | |
| 10,974,096 | B2 * | 4/2021 | Simmons | A63B 23/0405 |
| 11,253,743 | B1 * | 2/2022 | Mosqueda | A63B 21/4039 |
| D952,076 | S | 5/2022 | Horita et al. | |
| 11,759,675 | B2 | 9/2023 | Peterson | |
| 11,779,798 | B2 | 10/2023 | Drumheller | |
| 12,048,862 | B2 * | 7/2024 | Drath | A63B 21/00047 |
| 2002/0151419 | A1 * | 10/2002 | Barnes | A63B 23/0211 482/142 |
| 2002/0183171 | A1 | 12/2002 | Taylor et al. | |
| 2004/0002409 | A1 * | 1/2004 | Webb | A63B 23/0494 482/94 |
| 2004/0209745 | A1 * | 10/2004 | Riney | A63B 23/1263 482/97 |
| 2008/0058172 | A1 | 3/2008 | Tyree | |
| 2008/0064576 | A1 * | 3/2008 | Tyree | A63B 21/4007 482/129 |
| 2013/0210588 | A1 | 8/2013 | Derrick | |
| 2014/0066276 | A1 * | 3/2014 | Hornback | A63B 21/00069 482/145 |
| 2015/0011370 | A1 | 1/2015 | Henniger | |
| 2016/0184630 | A1 * | 6/2016 | Meredith | A63B 21/4034 482/133 |
| 2016/0236031 | A1 | 8/2016 | Nouri | |
| 2016/0256723 | A1 * | 9/2016 | Intlekofer | A63B 21/1627 |
| 2016/0354627 | A1 | 12/2016 | Cygan et al. | |
| 2017/0014681 | A1 | 1/2017 | Doherty | |
| 2020/0101348 | A1 | 4/2020 | Davis et al. | |
| 2020/0129806 | A1 | 4/2020 | Simmons | |
| 2022/0258003 | A1 | 8/2022 | Peterson | |
| 2023/0045004 | A1 | 2/2023 | Klein | |
| 2023/0201653 | A1 | 6/2023 | Drumheller | |
| 2025/0134763 | A1 * | 5/2025 | Jeppsson | A61H 31/006 |

FOREIGN PATENT DOCUMENTS

| | | |
|---|---|---|
| JP | 2021074537 | 5/2021 |
| WO | 2006101311 | 9/2006 |

OTHER PUBLICATIONS

Rogue Fitness, Westside Inverse Curl, found online via https://www.roguefitness.com/westside-inverse-curl. Last accessed Dec. 12, 2023.

Rogue Fitness, Westside Inverse Curl from elitefts.com, found online via https://www.youtube.com/watch?v=fzNK4Dndang. Last accessed Dec. 12, 2023.

Dynamic Fitness & Strength, Iconic Inverse Curl, found online via https://www.mydynamicfitness.com/equipment/plate-loaded/iconic-inverse-leg-curl. Last accessed Dec. 12, 2023.

Dynamic Fitness & Strength, Iconic Inverse Curl Demonstration, found online via https://www.youtube.com/watch?v=zixnD2nYiic. Last accessed Dec. 12, 2023.

Steelflex Plate Load Series Instruction Video-PLLC (Leg Curl Machine), found online via https://www.youtube.com/watch?v=LE_TPTMBvdA. Last accessed Dec. 12, 2023.

Rogue Fitness, Equipment Demo—GHRs on the Rogue Abram GHD, found online via https://www.youtube.com/watch?v=z15C9UZUbss. Last accessed Dec. 12, 2023.

Flame Sport, Inverse Curl Machine (4LX), Professional Gym Equipment, found online via https://www.flame-sport.de/en/inverse-curl-machine-4lx.html. Last accessed Dec. 12, 2023.

Flame Sport, Back workout with Inverse Curl Machine (4LX) Flame Sport, found online via https://www.youtube.com/watch?v=Bf3xn4Pul4o. Last accessed Dec. 12, 2023.

Flame Sport, Inverse Curl Machine (4LX), found online via https://www.youtube.com/watch?v=4H5cltpLIFw. Last accessed Dec. 12, 2023.

* cited by examiner

EXERCISE APPARATUSES FOR LEG STRENGTHENING

FIELD

The present disclosure relates to exercise apparatuses for leg strengthening and in non-limiting embodiments for performance of hamstring curl exercises, including but not limited to Nordic hamstring curl exercises.

BACKGROUND

U.S. Pat. No. 10,786,705 is incorporated herein by reference and discloses an exercise machine for leg strengthening, the exercise machine comprising a stationary frame; and a thigh support member and an ankle support member coupled to the frame and configured to support a user's thigh and ankle, respectively, during a hamstring curl exercise motion. The thigh support member and the ankle support member are each movable with respect to the stationary frame during the hamstring curl exercise motion, thus facilitating contraction and extension of both of a hamstring and glute of the user during the hamstring curl exercise motion.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In non-limiting embodiments disclosed herein, an exercise apparatus is for leg strengthening. The exercise apparatus comprises a frame longitudinally extending from a front to a rear, vertically extending from a top to a bottom, and laterally extending from a first side to a second side, a knee support configured to support a knee of a user relative to the frame, and a leg brace configured to brace a lower leg of the user relative to the frame. A linkage assembly is configured to facilitate performance of a hamstring curl exercise motion in which a chest of the user is lowered and then raised relative to the frame. The linkage assembly comprises a driver arm pivotably coupled to the frame and configured to support the chest of the user, a loaded arm pivotably coupled to the frame above the driver arm, the loaded arm providing or supporting a load, and a connecting arm pivotably coupling the driver arm to the loaded arm so that lowering of the chest during the hamstring curl exercise motion is resisted by the load and so that raising of the chest during the hamstring curl exercise motion is assisted by the load.

In independent embodiments, the driver arm may be coupled to the frame along a driver arm pivot axis and the loaded arm may be coupled to the frame along a loaded arm pivot axis located above the driver arm pivot axis.

In independent embodiments, the loaded arm pivot axis may be located rearwardly of the driver arm pivot axis. In independent embodiments, the connecting arm may be coupled to the driver arm and the loaded arm rearwardly of the driver arm pivot axis.

In independent embodiments, the connecting arm may be coupled to the driver arm along a lower connecting arm pivot axis located rearwardly of the driver arm pivot axis, and the connecting arm may be coupled to the loaded arm along an upper connecting arm pivot axis located rearwardly of the loaded arm pivot axis. In independent embodiments, the loaded arm may comprise an elongated member and a standoff extending upwardly from the elongated member, the upper connecting arm pivot axis extending through the standoff.

In independent embodiments, the driver arm may comprise a front portion extending forwardly of the driver arm pivot axis and may be configured to support the chest of the user and a rear portion extending rearwardly of the driver arm pivot axis and coupled to the loaded arm via the connecting arm. In independent embodiments, the connecting arm may comprise a lower portion coupled to the rear portion of the driver arm and an upper portion coupled to the loaded arm. In independent embodiments, the loaded arm may comprise a forward portion which is pivotably coupled to the frame and a rearward portion providing or supporting the load, wherein the connecting arm is coupled to the loaded arm between the forward portion and the rearward portion of the loaded arm. In independent embodiments, the exercise apparatus may comprise a standoff extending upwardly from the connecting arm, the connecting arm being coupled to the loaded arm via the standoff.

In independent embodiments, the driver arm pivot axis may be located longitudinally in line with the knee support relative to the frame. In independent embodiments, the driver arm pivot axis may be located vertically in-line with the knee support relative to the frame.

In independent embodiments, the knee support may be configured to register the knee of the user longitudinally in line with the driver arm pivot axis. In independent embodiments, the knee support may be configured to register the knee of the user vertically in-line with the driver arm pivot axis. In independent embodiments, the knee support may comprise a groove configured to register the knee on the knee support in line with the driver arm pivot axis.

In independent embodiments, the exercise apparatus may comprise an end stop configured to prevent further lowering of the chest of the user past an end position relative to the frame. In independent embodiments, the end stop may comprise a bumper which is engaged by the driver arm when the chest of the user is lowered to the end position. In independent embodiments, the end stop may be located relative to the driver arm so that the end stop is visible to the user as the chest of the user is lowered to the end position.

In independent embodiments, the exercise apparatus may comprise a chest pad for engaging the chest of the user, the chest pad being supported on the driver arm by an adjustment mechanism that facilitates adjustment of a position of the chest pad relative to the driver arm to accommodate use of the exercise apparatus by different users of different body sizes.

In independent embodiments, the leg brace may be repositionable relative to the frame to accommodate use of the exercise apparatus by different users having different body sizes. In independent embodiments, the leg brace may be coupled to the frame by a weldment which is configured to be secured to the frame in a first orientation accommodating a first body size of the user and a second orientation accommodating a different, second body size of a different user.

In non-limiting embodiments disclosed herein, an exercise apparatus is for leg strengthening. The exercise apparatus comprises a frame longitudinally extending from a front to a rear, vertically extending from a top to a bottom, and laterally extending from a first side to a second side, a knee support configured to support a knee of a user relative to the frame, and a leg brace configured to brace a lower leg of the user relative to the frame. A linkage assembly is configured to facilitate performance of a hamstring curl exercise motion in which a chest of the user is lowered to a lowest position and then raised again relative to the frame. The linkage assembly is configured such that in the lowest position a resulting force applied to the chest of the user corresponds to a ratio of a resistance load provided by the linkage assembly to the resulting force. The linkage assembly comprises a driver arm pivotably coupled to the frame and configured to support the chest of the user and a loaded arm pivotably coupled to the frame above the driver arm. The loaded arm provides or supports a load and being coupled to the driver arm so that lowering of the chest during the hamstring curl exercise motion is resisted by the load and so that raising of the chest during the hamstring curl exercise motion is assisted by the load.

In independent embodiments, the driver arm may be coupled to the frame along a driver arm pivot axis and the loaded arm may be coupled to the frame along a loaded arm pivot axis located above the driver arm pivot axis. In independent embodiments, the loaded arm pivot axis may be located rearwardly of the driver arm pivot axis.

In independent embodiments, the exercise apparatus may comprise a connecting arm pivotably coupling the driver arm to the loaded arm so that lowering of the chest during the hamstring curl exercise motion is resisted by the load and so that raising of the chest during the hamstring curl exercise motion is assisted by the load. In independent embodiments, said driver arm may be coupled to the frame along a driver arm pivot axis and said connecting arm may be coupled to the driver arm and the loaded arm rearwardly of the driver arm pivot axis. In independent embodiments, said driver arm may be coupled to the frame along a driver arm pivot axis, said connecting arm may be coupled to the driver arm along a lower connecting arm pivot axis located rearwardly of the driver arm pivot axis, and said connecting arm may be coupled to the loaded arm along an upper connecting arm pivot axis located rearwardly of the loaded arm pivot axis.

In independent embodiments, said loaded arm may be coupled to the frame along a loaded arm pivot axis and said knee support may be configured to register the knee of the user longitudinally in line with the driver arm pivot axis. In independent embodiments, the knee support may be configured to register the knee of the user at least one of vertically in-line with the driver arm pivot axis and horizontally in-line with the driver arm pivot axis.

In independent embodiments, the exercise apparatus may comprise an end stop configured to prevent further lowering of the chest of the user past an end position relative to the frame.

In independent embodiments, said ratio of the resistance load provided by the linkage assembly to the resulting force may be at least fifty percent. In independent embodiments, said ratio of the resistance load provided by the linkage assembly to the resulting force may be at least eighty percent. In independent embodiments, said resulting force applied to the chest of the user may be substantially equal to the resistance load provided by the linkage assembly.

BRIEF DESCRIPTION OF THE DRAWINGS

Embodiments are described with reference to the following drawing figures. The same numbers are used throughout to reference like features and components.

DETAILED DESCRIPTION OF THE DRAWINGS

Figure 1:
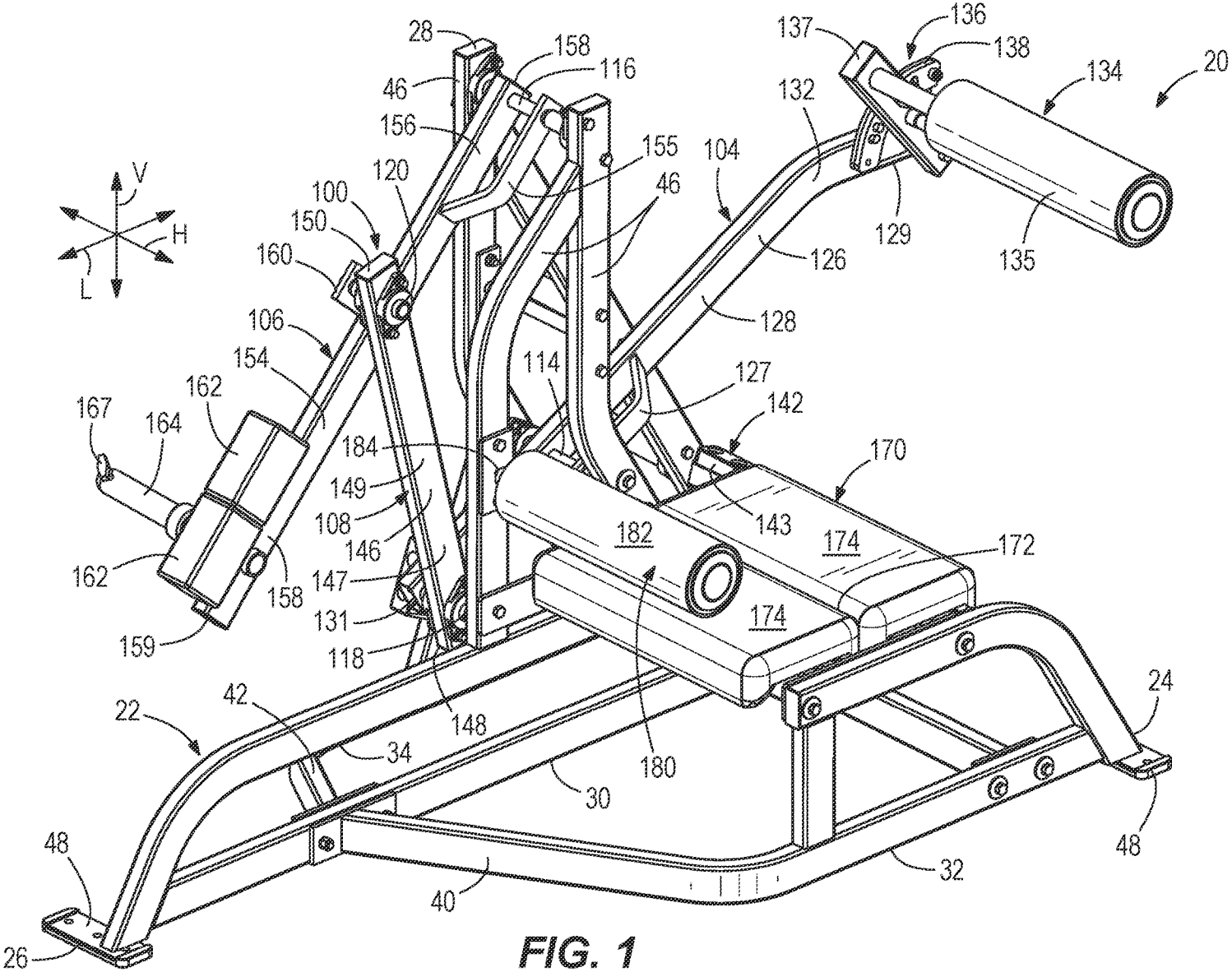
FIG. 1 is a first side perspective view of an exercise apparatus for leg strengthening.

As used herein, unless otherwise limited or defined, discussion of particular directions is provided by example only, with regard to particular embodiments or relevant illustrations. For example, discussion of "top," "bottom," "front," "rear," "left," "right," "horizontal," "vertical," and "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments.

During research and development, the present inventors determined that prior art exercise machines, for example conventional inverse leg curl machines and/or other exercise machines for performing hamstring curl exercise motions, including but not limited to Nordic hamstring curl exercises, are configured for athletic training facilities where a coach or trainer is available to help the user adjust the machine. Due to the abundant adjustability options, the inventors determined that said machines are often not user-friendly to the typical person who does not use a professional athletic facility.

During research and development, the present inventors further determined that prior art inverse leg curl machines often include a direct coupling between a driver arm acted on by the user and a load-bearing arm that supports weights, which results in a user needing to place a relatively large number of weight plates on the load bearing arm. Requiring a large number of weight plates for an exercise machine is time-consuming for the user and resource intensive for the facility. Furthermore, the inventors determined that, when the user is relatively inexperienced with an exercise machine and does not have trainer assistance, the user may misjudge the correct number of weights for the exercise. For this reason, the present inventors determined that more time is consumed as the user adds/removes more weighted plates to determine the correct counterbalance and a level of risk is imposed on the user as loading an insufficient counterbalance can lead to rapid eccentric contraction, muscle injury, and/or falling.

The present inventors thus have realized a need in the art to provide an improved exercise machine that advantageously reduces the amount of weight required to perform a hamstring curl exercise motion, provides intuitive supports and/or braces to assist a user in properly positioning themselves on the machine without assistance, and that prevents over rotation of moving components of the machine that may lead to injury. The present disclosure is a result of these efforts.

FIGS. 1-4 illustrate an embodiment of an exercise apparatus 20 that includes a frame 22 and a novel linkage assembly 100 that is actuated by a user to perform an exercise motion. In particular, the illustrated linkage assembly 100 is configured to facilitate performance of a hamstring curl exercise motion in which a chest of the user is lowered and then raised relative to the frame 22. Some embodiments of an exercise apparatus 20, however, may include a linkage assembly 100 that is configured for the performance of a different type of exercise motion. For example, embodiments of the linkage assembly 100 may be used in a leg press machine, a pendulum squat machine, and/or the like. Additionally or alternatively, the linkage assembly 100 may be arranged on an exercise machine to resist movement of the user without assisting the user over a portion of an exercise movement.

Referring now to FIGS. 1-5 the frame 22 of the exercise apparatus 20 extends longitudinally from a front end 24 to a rear end 26, vertically from a top end 28 to a bottom end 30, and horizontally from a first lateral side 32 to a second lateral side 34. Support feet 48 are positioned on the bottom side of the frame 22 and are configured to support the exercise apparatus 20 on the floor, and to prevent the exercise apparatus 20 from tipping. The illustrated frame 22 includes a first frame assembly 40 and a second frame assembly 42 that include the first and second lateral sides 32, 34, respectively. Each of the frame assemblies 40, 42 includes at least one vertical frame member 46 that extends upwardly from the bottom end 30 of the frame 22 to the top end 28 thereof. As discussed in further detail below, the vertical frame members 46 are configured to pivotably support the linkage assembly 100 between the first frame assembly 40 and the second frame assembly 42. The first frame assembly 40 includes a knee support 170 supported by frame members 44 (FIG. 4) above the bottom end 30 of the frame 22 adjacent to the vertical frame members 46 and the linkage assembly 100. Additionally, a leg brace 180 is supported on a vertical frame member 46 of the first frame assembly 40 above the knee support 170. As discussed in further detail below, the knee support 170 and the leg brace 180 are configured to support and brace a user in the proper position on the frame 22 for performance of the hamstring curl exercise movement. As illustrated in FIGS. 2-5, the second frame assembly 42 includes weight storage horns 165 configured to support stored weight plates (not shown) when said weight plates are not in use for performing an exercise motion on the exercise apparatus 20.

In the illustrated embodiments, the linkage assembly 100 is configured as a bar linkage that includes a driver arm 104, a loaded arm 106, and a connecting arm 108 that operatively links the driver arm 104 to the loaded arm 106. The driver arm 104 is pivotably coupled to the frame 22 and configured to support the chest of the user during performance of the exercise motion. The loaded arm 106 is pivotably coupled to the frame 22 above the driver arm 104 and is configured to provide and/or support a load. The connecting arm 108 pivotably couples the driver arm 104 to the loaded arm 106 so that the load resists lowering of the user's chest during the hamstring curl exercise motion and assists raising of the user's chest during the hamstring curl exercise motion. Connecting the driver arm 104 to the loaded arm 106 via at least one connecting arm 108 enables a pivot axis 116 of the loaded arm 106 on the frame 22 to be offset (e.g., vertically offset, longitudinally offset, etc.) from a pivot axis 114 of the driver arm 104 on the frame 22. This enables the loaded arm 106 to be longer than load-bearing arms of the prior art. As a result, fewer weight plates can be mounted on the loaded arm 106 to provide a sufficient counterbalance load for the exercise apparatus 20.

Figure 2:
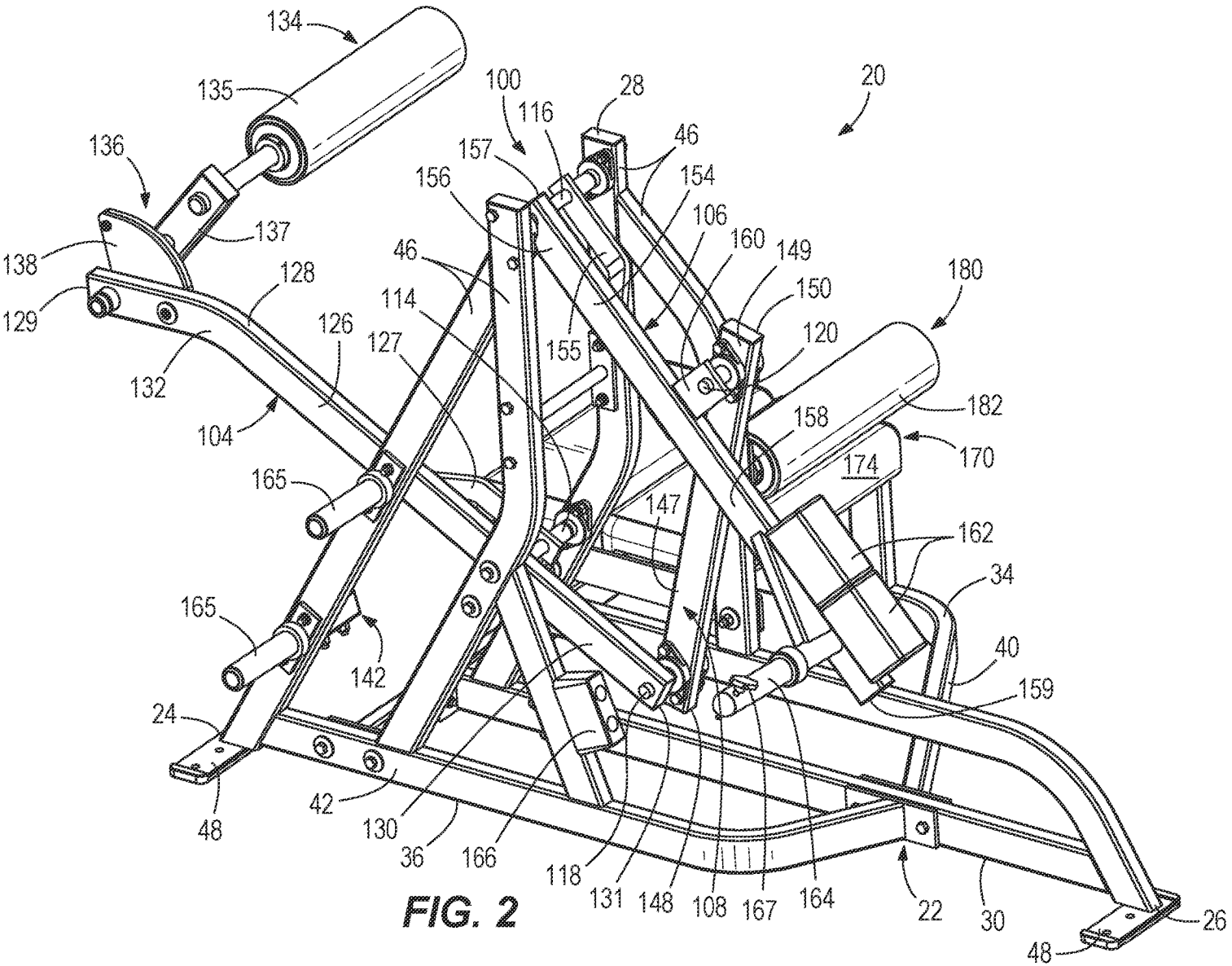
FIG. 2 is a second side perspective view of the exercise apparatus of FIG. 1.
Figure 3:
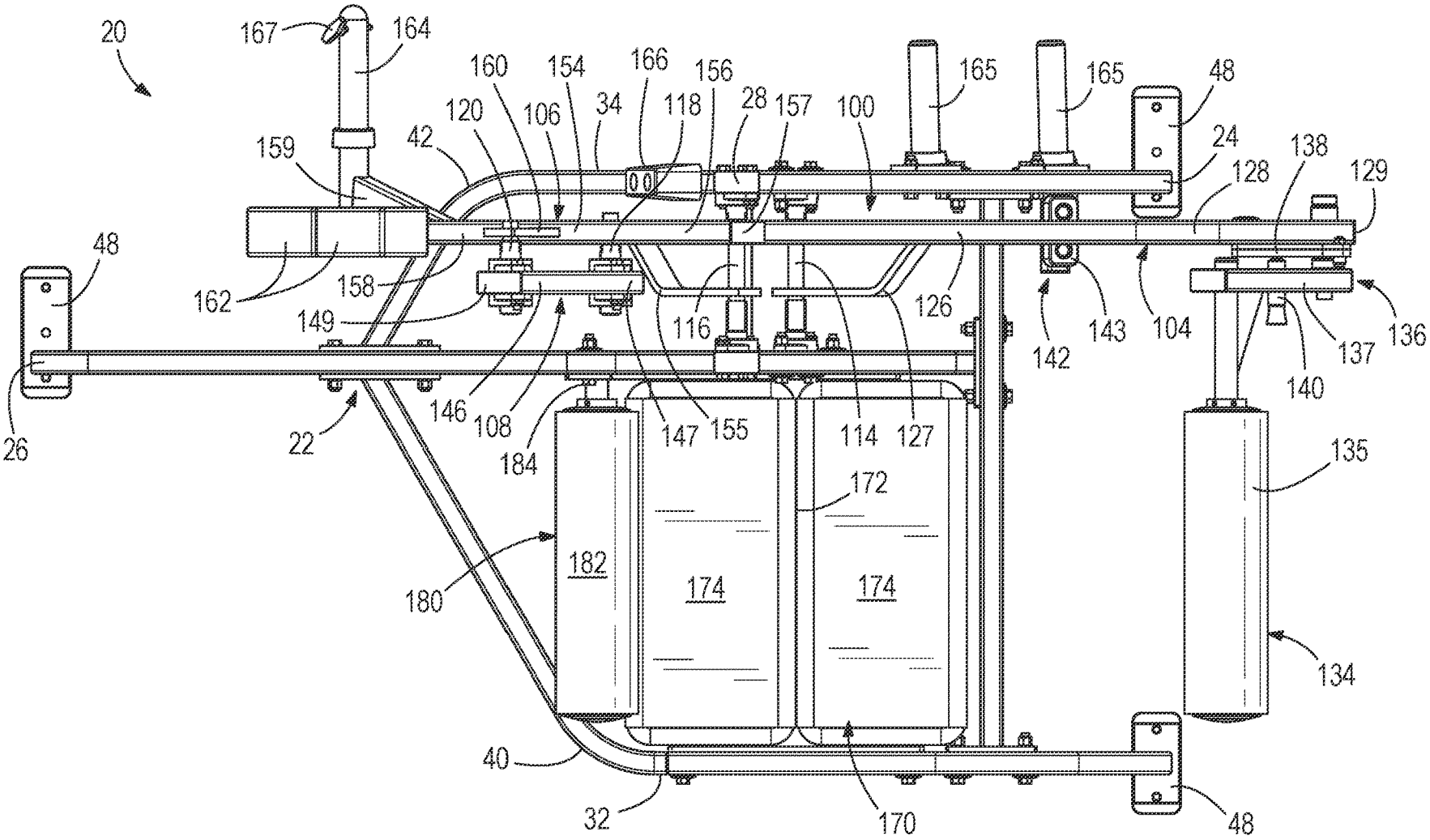
FIG. 3 is a top-down view of the exercise apparatus of FIG. 3.
Figure 4:
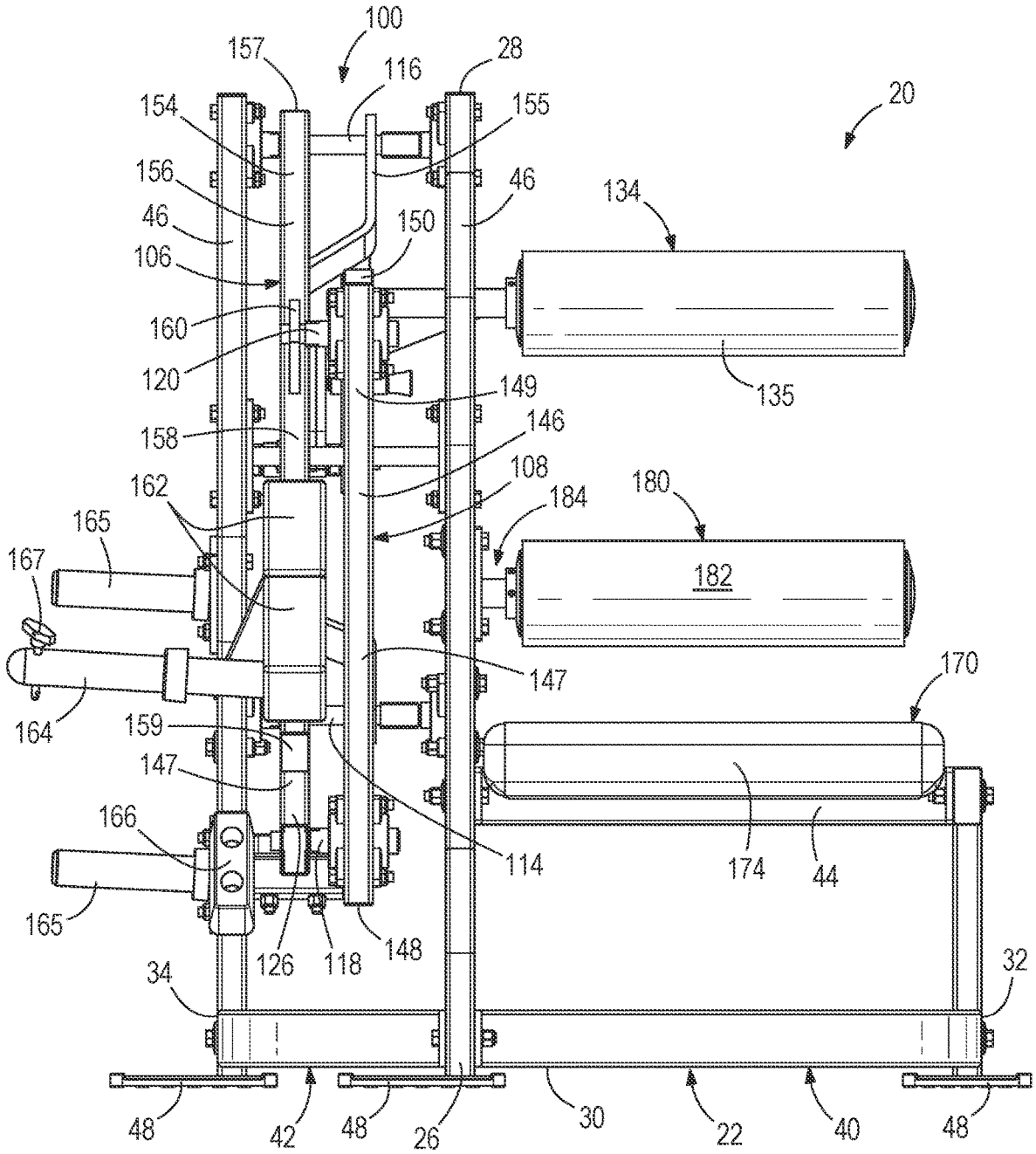
FIG. 4 is a rear elevation view of the exercise apparatus of FIG. 3.
Figure 5:
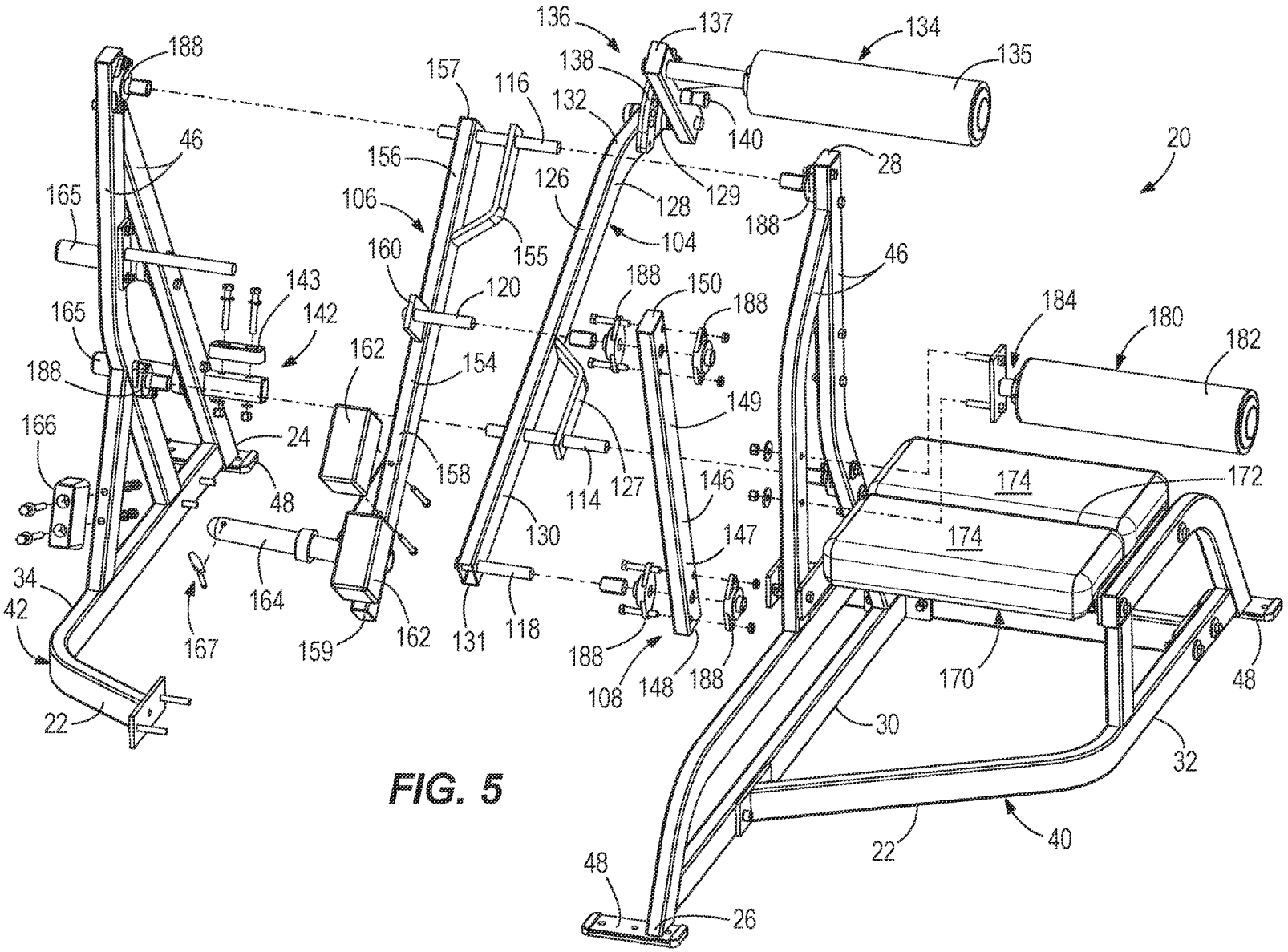
FIG. 5 is an exploded perspective view of the exercise apparatus of FIG. 4.
Figure 9:
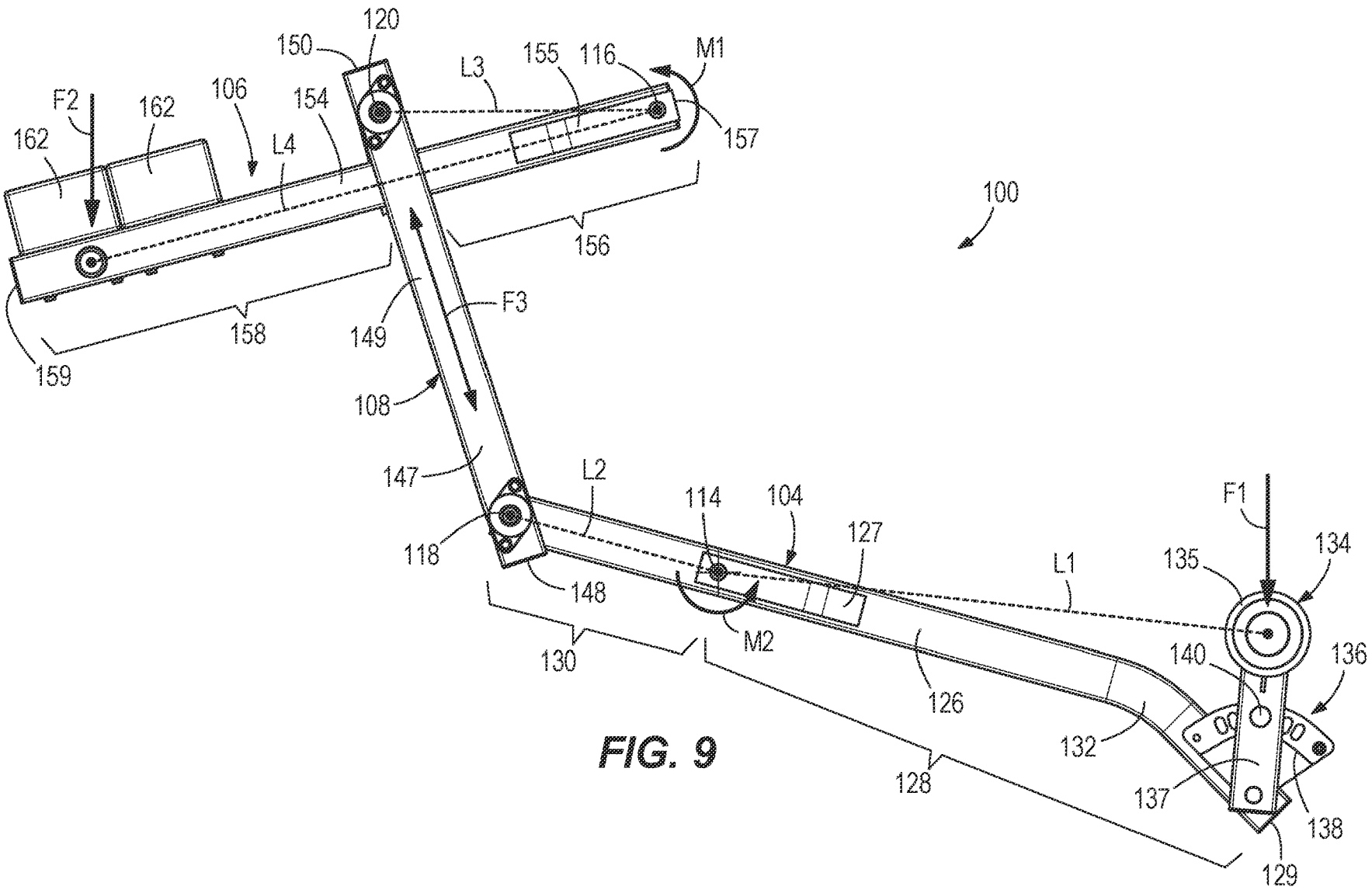
FIG. 9 is a side view of the linkage assembly of the exercise apparatus of FIG. 8 with the frame of the exercise apparatus omitted.

Referring to FIGS. 2, 5, and 9, the driver arm 104 includes an elongated member 126 that is pivotably coupled to the frame 22 along a driver arm pivot axis 114, which extends laterally relative to the body of the elongated member 126. At least one pivot bearing 188 (FIG. 5) may be configured to support the driver arm pivot axis 114 on the frame 22. The elongated member 126 of the driver arm 104 includes a front portion 128 extending forwardly of the driver arm pivot axis 114 to a front end 129 and a rear portion 130 extending rearwardly of the driver arm pivot axis 114 to a rear end 131 opposite the front end 129. A horizontal support member 127 extends horizontally outward from the elongated member 126 and rearward to the driver arm pivot axis 114 to improve the rigidity and stability of the driver arm 104 on the frame 22.

Figure 6:
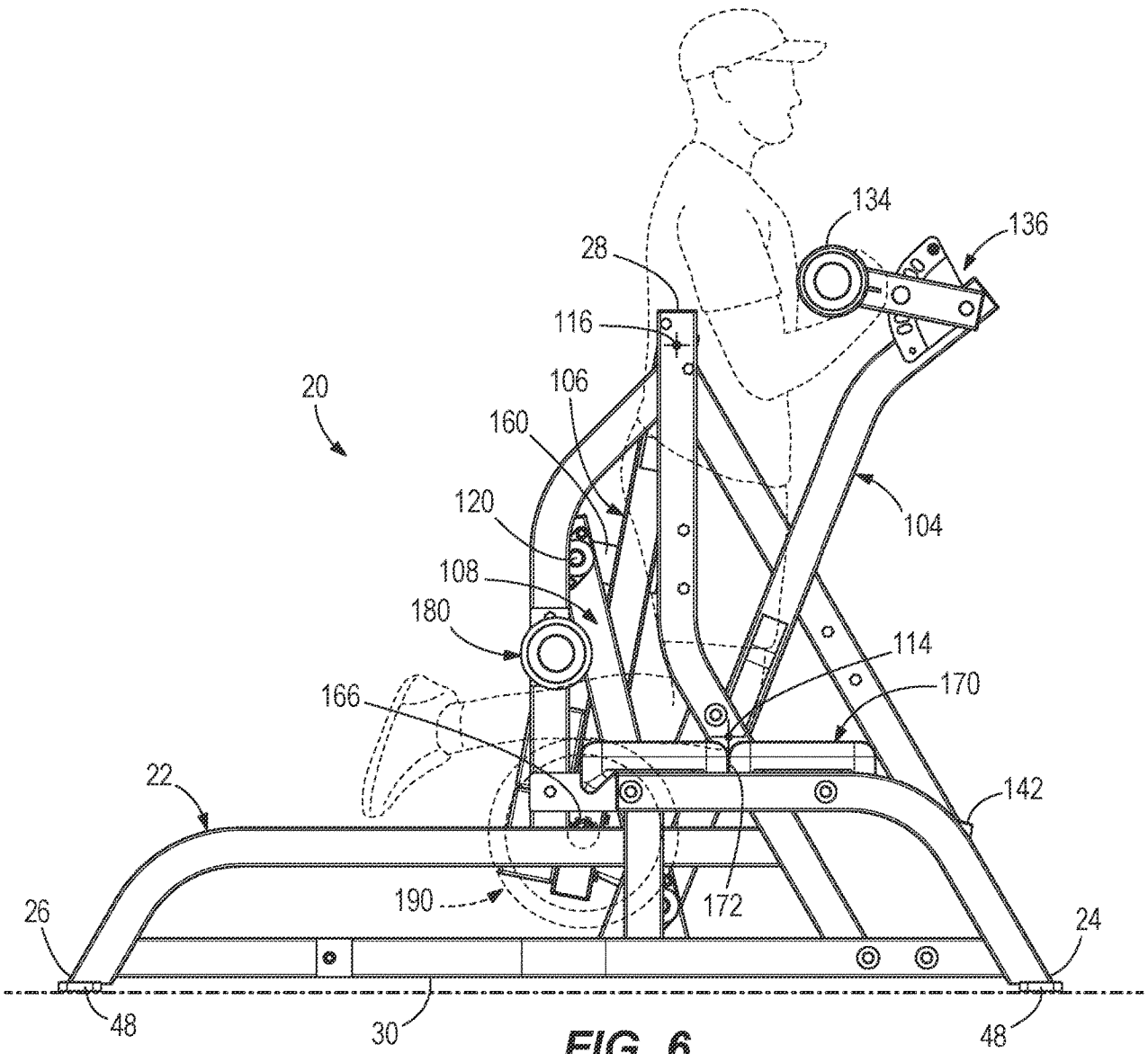
FIG. 6 is a side elevation view of the exercise apparatus of FIG. 5, with a linkage assembly of the exercise apparatus in a start position.
Figure 7:
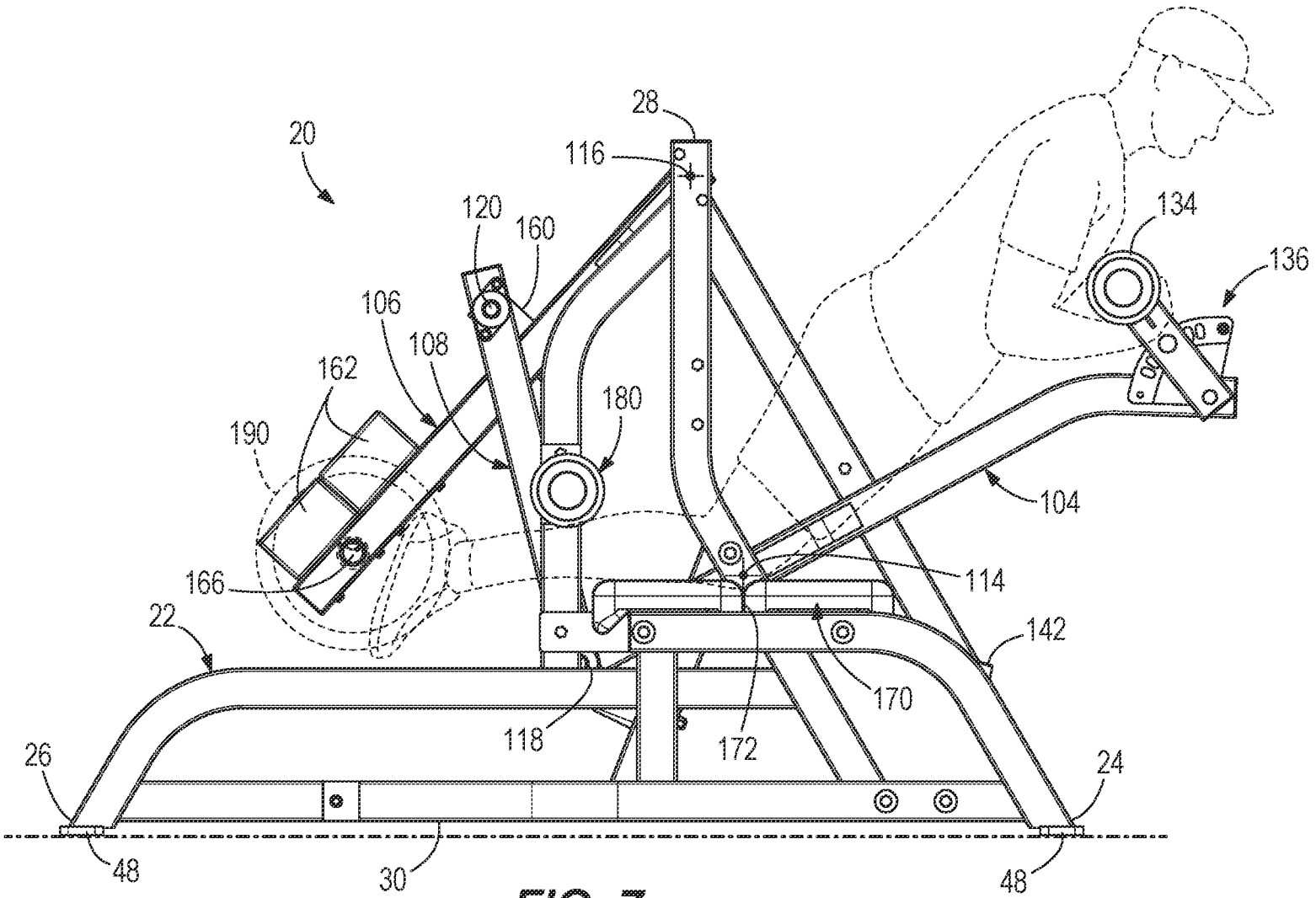
FIG. 7 is the side elevation view of the exercise apparatus of FIG. 6, with the linkage assembly of the exercise apparatus in an intermediate position.
Figure 8:
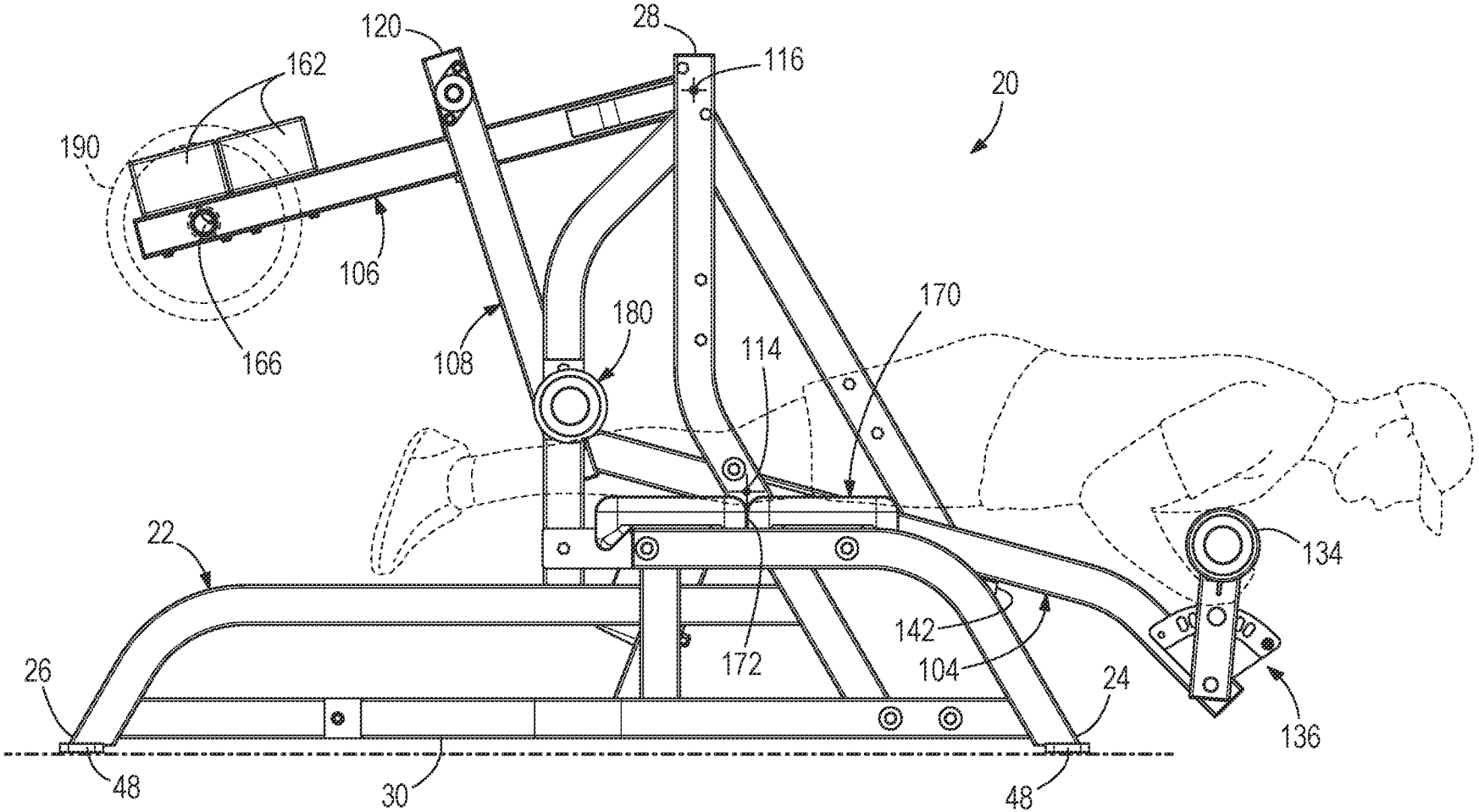
FIG. 8 side elevation view of the exercise apparatus of FIG. 7, with the linkage assembly of the exercise apparatus in an end position.

The driver arm 104 includes a chest support 134 at the front end 129 thereof which is configured to support the chest of the user and be acted on by the user (via the user's chest) during the performance of the exercise motion (see, e.g., FIGS. 6-8). The chest support 134 includes a chest pad 135 for engaging the chest of the user. The driver arm 104 further includes an adjustment mechanism 136 to support the chest pad 135 on the front end 129 and to facilitate the adjustment of a position of the chest pad 135 relative to the driver arm 104. Thus, the adjustment mechanism 136 accommodates use of the exercise apparatus by different users of different body sizes. In the illustrated embodiment, the adjustment mechanism 136 includes an adjustment arm 137 that is pivotably connected to the driver arm 104 and supports the chest pad 135, a selector bracket 138 that has a plurality of holes and is fixed on the front end 129 of the driver arm 104, and a selector pin 140. Pivoting the adjustment arm 137 aligns a mounting hole in the adjustment arm 137 with one of the holes in the selector bracket 138, each of which corresponds to a different selectable position of the chest pad 135. The selector pin 140 can be manually inserted into the aligned holes to lock the adjustment arm 137 in position with respect to the selector bracket 138 and the driver arm 104, thereby locking the chest pad 135 in a desired position. Advantageously, the front portion 128 of the driver arm 104 includes a generally downward bend 132 to orient the adjustment mechanism 136 so that the chest pad 135 stays relatively aligned with the driver arm 104. In other words, the bend 132 causes an angle of a line of action L1 (FIG. 9) between the driver arm pivot axis 114 and the chest pad 135 to remain relatively unchanged as the position of the chest pad 135 is changed, as discussed in greater detail below.

With continued reference to FIGS. 2, 5, and 9, the loaded arm 106 includes an elongated member 154 that is pivotably coupled to the frame 22 along a loaded arm pivot axis 116, which extends laterally relative to the body of the elongated member 154 and is located above the driver arm pivot axis 114 and rearwardly of the driver arm pivot axis 114 on the frame 22. At least one pivot bearing 188 (FIG. 5) may be configured to support the loaded arm pivot axis 116 on the frame 22. The elongated member 154 of the loaded arm 106 includes a front portion 156 extending forwardly of a standoff 160 to a front end 157 including the loaded arm pivot axis 116. Furthermore, the elongated member 154 includes a rear portion 158 extending rearwardly of the standoff 160 to a rear end 159 opposite the front end 157.

Similar to the driver arm 104, the loaded arm 106 includes a horizontal support member 155 configured to improve the rigidity and stability of the driver arm 104 on the frame 22.

At the rear end 159 of the elongated member 154, the loaded arm 106 includes at least one of a preload weight 162 and a weight horn 164 (FIGS. 2 and 5) configured to support an additional load in the form of attachable weight plates 190 (FIGS. 6-8). The preload weight(s) 162 are configured to provide a load which counteracts the weight of the driver arm 104 to balance the linkage assembly 100. The weight plates 190 may be mounted on the weight horn 164 and secured thereon by a pin 167. The loads provided by the preload weight(s) 162 and weight plates 190 mounted on the weight horn 164 are configured to provide the loads that resist the lowering of the user's chest and assist the raising of the user's chest during the hamstring curl exercise motion.

As previously mentioned, the linkage assembly 100 includes a connecting arm 108 that operatively couples the driver arm 104 to the loaded arm 106. In particular, the illustrated connecting arm 108 is pivotably coupled to the driver arm 104 and to the loaded arm 106 so that lowering of the user's chest during the hamstring curl exercise motion is resisted by the load(s) on the loaded arm 106, and so that raising of the user's chest during the hamstring curl exercise motion is assisted by said load(s).

Referring to FIGS. 2, 5, and 9, the connecting arm 108 includes an elongated member 146 that extends between a lower end 148 and an upper end 150. A lower portion 147 of the connecting arm 108 is pivotably coupled to the driver arm 104 along a lower connecting arm pivot axis 118, which is located at the lower end 148 of the connecting arm 108 and rearwardly of the driver arm pivot axis 114 at the rear end 131 of the driver arm 104. An upper portion 149 of the connecting arm 108 is coupled to the loaded arm 106 along an upper connecting arm pivot axis 120, which is located rearwardly of the loaded arm pivot axis 116 between the forward portion 156 and the rear portion 158 of the loaded arm 106. At least one pivot bearing 188 (FIG. 5) may be configured to support the lower and/or upper connecting arm pivot axis 118, 120 on the driver arm 104 and/or the loaded arm 106, respectively.

In the illustrated embodiments, the upper connecting arm pivot axis 120 extends through the standoff 160 on the loaded arm 106. The standoff 160 extends upwardly from the elongated member 154 of the loaded arm 106 such that the upper connecting arm pivot axis 120 is spaced apart from the loaded arm 106. Advantageously, the connection of the connecting arm 108 and the loaded arm 106 via the standoff 160 prevents the linkage assembly 100 from binding during the exercise motion, thereby reducing undesirable jerking and uneven changes in the force applied to the user's chest during the exercise motion. In the illustrated embodiments, the standoff 160 is oriented substantially perpendicular or normal to the elongated member 154 of the loaded arm 106. However, in other embodiments, the standoff 160 can extend from the elongated member 154 of the loaded arm 106 at an angle such as 30 degrees, 45 degrees, 60 degrees, etc.

Referring to FIG. 9, during research and experimentation, the inventors determined that the dimensions of the driver arm 104, the loaded arm 106, and the connecting arm 108 and/or the locations of their respective pivot axes 114, 116, 118, 120 may be sized/located to adjust the ratio of a resistance load F2 provided by the linkage assembly 100 (e.g., via the load(s) on the loaded arm 106) and a resulting force F1 applied to the chest of the user. In particular, the inventors determined, for example through use of a conventional system of mathematical equations balancing the resistance load F2 applied by the mass of the load(s) on the loaded arm 106, a moment M1 of the loaded arm 106 about the loaded arm pivot axis 116, a force F3 transmitted between the loaded arm 106 and the driver arm 104 via the connecting arm 108, a moment M2 of the driver arm 104 about the driver arm pivot axis 114, and the resulting force F1 applied to the chest of the user is a function of the lengths of various segments of the driver arm 104, the loaded arm 106, and the connecting arm 108, and the relative locations and lengths of lines of action L1, L2, L3, L4 between the various pivot axes 114, 116, 118, 120.

In the illustrated embodiment, the inventors determined that the resulting force F1 applied to the chest of the user due to the resistance load F2 is a function of the line of action L1 between the chest support 134 and the driver arm pivot axis 114; a line of action L2 between the driver arm pivot axis 114 and the lower connecting arm pivot axis 118; a line of action L3 between the upper connecting arm pivot axis 120 and the loaded arm pivot axis 118; and a line of action L4 between the loaded arm pivot axis 116 and a center of gravity of the load(s) supported on or provided by the loaded arm 106. Thus, the resulting force F1 may be calculated using the equation $F1=F2(L4/L3)/(L1/L2)$, and the ratio (R1) of the resulting force F1 to the resistance load F2 is calculatable using $R1=(L4/L3)/(L1/L2)$.

Advantageously, the exercise apparatus 20 may be configured to achieve a desired ratio of the resistance load F2 and the resulting force F1 applied to the user by the linkage assembly 100 by dimensioning the driver arm 104, the loaded arm 106, and/or the connecting arm 108 and/or positioning their respective pivot axes 114, 116, 118, 120 on the frame based on a calculation of the ratio R1. In the illustrated embodiment of FIG. 9, the linkage assembly 100 is configured such that the resistance load F2 provided by the linkage assembly 100 is substantially equal to the resulting force F1 applied to the chest of the user when the linkage assembly 100 is in its lowest position (FIG. 8). This may be useful, for example, to reduce the number and/or weight(s) of any weight plate(s) 190 which must be mounted on the loaded arm 108 to achieve a desire resulting force F1.

Additionally or alternatively, embodiments of the exercise apparatus 20 may be configured to provide a different ratio R1 between the resistance load F2 and the resulting force F1. In some embodiments, the exercise apparatus 20 may be configured to provide a ratio R1 of the resistance load F2 to the resulting force F1 that is less than 1:1. For example, an exercise apparatus 20 may be configured such that the ratio R1 of the resistance load F2 to the resulting force F1 is approximately 0.80 in the lowest position of the linkage assembly 100 (i.e., such that the resulting force F1 is approximately 80% of the resistance load F2). This may be useful, for example, so that a user can adjust the desired resulting force F1 with more granularity with a standard set of weight plates. Additionally or alternatively, the exercise apparatus 20 may be configured to provide a ratio R1 that is more than 4:5 (i.e., $R1>0.8$) or less than 4:5 (i.e., $R1<0.8$). In some embodiments, the value of the ratio R1 may be equal to or between 0.5 and 1.0, e.g., 0.5, 0.55, 0.6, 0.65, 0.7, 0.75, 0.8, 0.85, 0.9, 0.95, 0.1, and any other ratio between the enumerated ratios. Further still, some embodiments of the exercise apparatus 20 may be configured to provide a ratio R1 that is less than 1:2 (i.e., $R1<0.5$).

As previously mentioned, the exercise apparatus 20 includes a knee support 170 and a leg brace 180 that are positioned on the frame and configured to support and brace a user in the proper position relative to the frame 22 and the linkage assembly 100 for the user to perform a hamstring curl exercise motion.

Referring to FIGS. 1 and 3-5, the knee support 170 is positioned on the first frame assembly 40 adjacent to the vertical frame members 46 and extends horizontally from the vertical frame members 46 to the first lateral side 32 of the frame 22. The illustrated knee support 170 includes two knee pads 174 positioned longitudinally adjacent relative to each other. A locating groove 172 is defined between the knee pads 174. The knee support 170 is positioned on the frame 22 such that the driver arm pivot axis 114 is located longitudinally in-line with the locating groove 172 (see, e.g., FIG. 3) and vertically in-line with the locating groove 172 (see, e.g., FIGS. 6-8). When performing the exercise motion, the locating groove 172 is configured to receive the knee of the user, thereby registering the user's knee on the knee support 170 in-line with the driver arm pivot axis 114. As illustrated in FIGS. 6-8, the locating groove 172 is configured to register the knee of the user vertically and longitudinally in-line with the driver arm pivot axis 114. Advantageously, registration of the user's knee in-line with the driver arm pivot axis 114 with the knee pad enables the user to properly position themselves on the exercise apparatus 20 without relying on assistance from a trainer, thereby helping to ensure safe, proper performance of the hamstring curl exercise motion.

With continued reference to FIGS. 1 and 3-5, the leg brace 180 is mounted on a vertical member 46 of the first frame assembly 40 and extends horizontally therefrom above the knee support 170. The leg brace 180 includes a leg pad 182 configured to be engaged by the legs of a user to brace the user relative to the frame 22 and the knee support 170, thereby helping to retain the knee of the user in the locating groove 172. In the illustrated embodiments, the leg brace 180 is configured as a repositionable leg brace 180 which may be repositioned relative to the frame 22 to accommodate use of the exercise apparatus 20 by different users having different body sizes. A weldment 184 couples the leg brace 180 the frame and is movable between at least two orientations, including the orientation shown and an opposite orientation rotated 180 degrees. Each orientation of the weldment 184 and the leg pad 182 accommodates a different body size of different users.

Referring to FIGS. 6-8, a user can perform the hamstring curl exercise motion by positioning themselves on the exercise apparatus 20 while the linkage assembly 100 is in a raised position (FIG. 6). To prevent the linkage assembly 100 from pivoting past the raised position (e.g., the maximum raised position, the start position, etc.), a loaded arm stop 166 (FIGS. 2, 4, 5) is positioned on the frame 22 and is configured to abut the weight horn 164 to prevent over rotation of the loaded arm 106. When positioned on the exercise apparatus 20, the knee of the user is registered in the locating groove 172 of the knee support 170 such that the user's knee is in-line with the driver arm pivot axis 114. As a result, the body of the user will pivot about an axis that is substantially in-line with the driver arm pivot axis 114, thereby improving the hamstring curl exercise motion to correctly target the corresponding muscle(s) of the user and preventing inefficient exercise motion, improper form, and/or reducing the risk of user injury. For example, when the user places their knee at the locating groove 172 of the knee support 170, the chest support 134 contacts relatively the same spot on the chest of the user during the hamstring curl exercise motion, which improves the efficiency of the exercise motion.

When the user begins the hamstring curl exercise motion, the linkage assembly 100 is in raised position (FIG. 6), and therefore the resulting force F1 exerted on the user is at a minimum. As the user continues to lower their body by pivoting about their knees, linkage assembly 100 is moved through intermediate positions (FIG. 7) as the driver arm 104 is forced downward and pivots about the driver arm pivot axis 114 and the loaded arm 106 pivots upwards about the loaded arm pivot axis 116. As the driver arm 104 and the loaded arm 106 pivot towards the lowered position (FIG. 8), the orientations of the driver and pivot arms 104, 106 move closer to a horizontal orientation relative to the ground. Thus, the angle between the lines of action L1, L2, L3, L4 (FIG. 9) of the driver and pivot arms 104, 106 and the vertically oriented resistance load F2 and the resulting force F1 approaches ninety degrees, thereby increasing the magnitude of the resulting force F1 felt by a user. Thus, the resistance to the exercise motion increases as the chest of the user lowers, advantageously increasing the resulting force F1 as the user performs a first portion (e.g., a lowering portion) of the exercise motion. Additionally, the variability of the resulting force F1 allows the linkage assembly 100 to provide a maximum force to assist the user in raising their chest when the linkage assembly 100 is in its lowest position (FIG. 8), which is when the user requires the greatest amount of assistance. Furthermore, the linkage assembly 100 causes the assisting resulting force F1 to decrease as the user performs a second portion (e.g., a raising portion) of the exercise motion, which is when the user requires less assistance.

To prevent the linkage assembly 100 from moving past the desired end position illustrated in FIG. 8 (i.e., lowest position), the exercise apparatus 20 includes an end stop 142 (FIGS. 1 and 5) positioned on the frame 22 proximate the front end 24 thereof. The end stop 142 includes a bumper 143 (FIG. 5) configured to be engaged by the driver arm 104 when the chest of the user is lowered to the end position of the exercise motion. Advantageously, the end stop 142 is located relative to the driver arm 104 so that the end stop 142 is visible to the user as the chest of the user is lowered to the end position, thereby preventing the user from experiencing a sudden, unexpected stop at the end position to reduce and/or eliminate the risk of injury to the user.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An exercise apparatus for leg strengthening, the exercise apparatus comprising:

a frame longitudinally extending from a front to a rear, vertically extending from a top to a bottom, and laterally extending from a first side to a second side, a knee support configured to support a knee of a user relative to the frame, a leg brace configured to brace a lower leg of the user relative to the frame, a linkage assembly configured to facilitate performance of a hamstring curl exercise motion in which a chest of the user is lowered and then raised relative to the frame, the linkage assembly including:

a driver arm pivotably coupled to the frame and configured to support the chest of the user, a loaded arm pivotably coupled to the frame above the driver arm, the loaded arm providing or supporting a load, and a connecting arm pivotably coupling the driver arm to the loaded arm so that lowering of the chest during the hamstring curl exercise motion is resisted by the load and so that raising of the chest during the hamstring curl exercise motion is assisted by the load.

2. The exercise apparatus according to claim 1, wherein the driver arm is coupled to the frame along a driver arm pivot axis and the loaded arm is coupled to the frame along a loaded arm pivot axis located above the driver arm pivot axis.

3. The exercise apparatus according to claim 2, wherein the loaded arm pivot axis is located rearwardly of the driver arm pivot axis.

4. The exercise apparatus according to claim 2, wherein the connecting arm is coupled to the driver arm and the loaded arm rearwardly of the driver arm pivot axis.

5. The exercise apparatus according to claim 2, wherein the connecting arm is coupled to the driver arm along a lower connecting arm pivot axis located rearwardly of the driver arm pivot axis and the connecting arm is coupled to the loaded arm along an upper connecting arm pivot axis located rearwardly of the loaded arm pivot axis.

6. The exercise apparatus according to claim 5, wherein the loaded arm includes an elongated member and a standoff extending upwardly from the elongated member, the upper connecting arm pivot axis extending through the standoff.

7. The exercise apparatus according to claim 2, wherein the driver arm includes a front portion extending forwardly of the driver arm pivot axis and configured to support the chest of the user, and a rear portion extending rearwardly of the driver arm pivot axis and coupled to the loaded arm via the connecting arm.

8. The exercise apparatus according to claim 7, wherein the connecting arm includes a lower portion coupled to the rear portion of the driver arm and an upper portion coupled to the loaded arm.

9. The exercise apparatus according to claim 7, wherein the loaded arm includes a forward portion pivotably coupled to the frame and a rearward portion providing or supporting the load, and wherein the connecting arm is coupled to the loaded arm between the forward portion and the rearward portion of the loaded arm.

10. The exercise apparatus according to claim 7, further including a standoff extending upwardly from the loaded arm, the connecting arm being coupled to the loaded arm via the standoff.

11. The exercise apparatus according to claim 2, wherein the driver arm pivot axis is located longitudinally in line with the knee support relative to the frame.

12. The exercise apparatus according to claim 11, wherein the driver arm pivot axis is located vertically in-line with the knee support relative to the frame.

13. The exercise apparatus according to claim 2, wherein the knee support is configured to register the knee of the user longitudinally in line with the driver arm pivot axis.

14. The exercise apparatus according to claim 13, wherein the knee support is configured to register the knee of the user vertically in-line with the driver arm pivot axis.

15. The exercise apparatus according to claim 2, wherein the knee support includes a groove configured to register the knee on the knee support in line with the driver arm pivot axis.

16. The exercise apparatus according to claim 1, further including an end stop configured to prevent further lowering of the chest of the user past an end position relative to the frame.

17. The exercise apparatus according to claim 16, wherein the end stop includes a bumper, the driver arm configured to engage the bumper when the chest of the user is lowered to the end position.

18. The exercise apparatus according to claim 17, wherein the end stop is located relative to the driver arm so that the end stop is visible to the user as the chest of the user is lowered to the end position.

19. The exercise apparatus according to claim 1, further including a chest pad for engaging the chest of the user, the chest pad being supported on the driver arm by an adjustment mechanism that facilitates adjustment of a position of the chest pad relative to the driver arm to accommodate use of the exercise apparatus by different users of different body sizes.

20. The exercise apparatus according to claim 1, wherein the leg brace is repositionable relative to the frame to accommodate use of the exercise apparatus by different users having different body sizes.

21. The exercise apparatus according to claim 20, wherein the leg brace is coupled to the frame by a weldment configured to be secured to the frame in a first orientation accommodating a first body size of the user and a second orientation accommodating a different, second body size of a different user.

22. An exercise apparatus for leg strengthening, the exercise apparatus comprising:

a frame longitudinally extending from a front to a rear, vertically extending from a top to a bottom, and laterally extending from a first side to a second side, a knee support configured to support a knee of a user relative to the frame, a leg brace configured to brace a lower leg of the user relative to the frame, a linkage assembly configured to facilitate performance of a hamstring curl exercise motion in which a chest of the user is lowered to a lowest position and then raised again relative to the frame, the linkage assembly configured such that a resulting force applied to the chest of the user in the lowest position corresponds to a ratio of a resistance load provided by the linkage assembly to the resulting force, the linkage assembly including:

a driver arm pivotably coupled to the frame and configured to support the chest of the user, and a loaded arm pivotably coupled to the frame above the driver arm, the loaded arm providing or supporting a load and being coupled to the driver arm so that lowering of the chest during the hamstring curl exercise motion is resisted by the load and so that raising of the chest during the hamstring curl exercise motion is assisted by the load.

23. The exercise apparatus according to claim 22, wherein the driver arm is coupled to the frame along a driver arm pivot axis and the loaded arm is coupled to the frame along a loaded arm pivot axis located above the driver arm pivot axis.

24. The exercise apparatus according to claim 23, wherein the loaded arm pivot axis is located rearwardly of the driver arm pivot axis.

25. The exercise apparatus according to claim 22, further including a connecting arm pivotably coupling the driver arm to the loaded arm so that lowering of the chest during the hamstring curl exercise motion is resisted by the load and so that raising of the chest during the hamstring curl exercise motion is assisted by the load.

26. The exercise apparatus according to claim 25, wherein said driver arm is coupled to the frame along a driver arm pivot axis and said connecting arm is coupled to the driver arm and the loaded arm rearwardly of the driver arm pivot axis.

27. The exercise apparatus according to claim 25, wherein said driver arm is coupled to the frame along a driver arm pivot axis, said connecting arm is coupled to the driver arm along a lower connecting arm pivot axis located rearwardly of the driver arm pivot axis, and said connecting arm is coupled to the loaded arm along an upper connecting arm pivot axis located rearwardly of the loaded arm pivot axis.

28. The exercise apparatus according to claim 22, wherein said loaded arm is coupled to the frame along a loaded arm pivot axis and said knee support is configured to register the knee of the user longitudinally in line with the driver arm pivot axis.

29. The exercise apparatus according to claim 28, wherein the knee support is configured to register the knee of the user at least one of vertically in-line with the driver arm pivot axis and horizontally in-line with the driver arm pivot axis.

30. The exercise apparatus according to claim 22, further including an end stop configured to prevent further lowering of the chest of the user past an end position relative to the frame.

31. The exercise apparatus according to claim 22, wherein said ratio of the resistance load provided by the linkage assembly to the resulting force is at least fifty percent.

32. The exercise apparatus according to claim 31, wherein said ratio of the resistance load provided by the linkage assembly to the resulting force is at least eighty percent.

33. The exercise apparatus according to claim 32, wherein said resulting force applied to the chest of the user is substantially equal to the resistance load provided by the linkage assembly.

* * * * *